United States Patent [19]

Batts et al.

[11] 4,198,773

[45] Apr. 22, 1980

[54] TALLY FOR ARTICLE DISPLAYS

[75] Inventors: John H. Batts; Judd F. Garrison, both of Grand Rapids, Mich.

[73] Assignee: John Thomas Batts, Inc., Zeeland, Mich.

[21] Appl. No.: 836,654

[22] Filed: Sep. 26, 1977

Related U.S. Application Data

[62] Division of Ser. No. 647,008, Jan. 2, 1976, Pat. No. 4,123,864.

[51] Int. Cl.[2] ..... G09F 3/00

[52] U.S. Cl. ..... 40/322; 40/316; 206/820

[58] Field of Search ..... 206/150; 820; 40/2 R, 40/324, 322, 20, 2, 316

[56] References Cited

U.S. PATENT DOCUMENTS

| | | | |
|---|---|---|---|
| 1,575,775 | 3/1926 | Lesser | 40/2 R |
| 3,491,472 | 1/1970 | Walldorf | 40/316 |
| 3,898,754 | 8/1975 | Johansson | 40/322 |
| 3,924,738 | 12/1975 | Poupitch | 206/150 |

*Primary Examiner*—Louis G. Mancene
*Assistant Examiner*—Wenceslao J. Contreras
*Attorney, Agent, or Firm*—Price, Heneveld, Huizenga & Cooper

[57] ABSTRACT

A tally system of article identification to be mounted on an article support such as a garment hanger is disclosed. In one form, tubular tallies are initially manufactured as an extruded tube and then severed into individual units of suitable length. In another form, they are individually manufactured. The article support may be provided with an upstanding boss or other projection over which the tallies are seated. The tallies and boss or other projection may be equipped with means for circumferentially indexing the tally to assure proper display. The tallies, as used, preferably have suitable information indicia applied to their exterior surface.

8 Claims, 27 Drawing Figures

FIG. 12. a

TALLY FOR ARTICLE DISPLAYS

This is a division of application, Ser. No. 647,008, filed Jan. 2, 1976, and now U.S. Pat. No. 4,123,864.

BACKGROUND OF THE INVENTION

In the merchandising of many articles, a need exists for a simple, inexpensive and readily changeable identification system whereby the customer can be quickly appraised of the precise nature of the product being displayed. While this need exists in the case of a number of different types of merchandise, it is particularly acute in the clothing field. It is common practice in this field to display a number of garments of the same general type which are differentiated by size. This is true whether the garments are for women's, men's or children's use.

While a number of identification systems have been proposed in the past and some of them have enjoyed significant acceptance, the systems have not been capable of realizing a truly satisfactory solution to the problem. An example of such an identificaton system is disclosed in U.S. Pat. No. 3,898,754 entitled CLOTHING DATA SYSTEM issued Aug. 12, 1975 to Gert Arne Johansson. Among other things, many of the proposed devices have not been capable of being so locked to the garment support element such as a garment hanger that they will positively remain in an effective display position. Others have been of a type such that, in many instances, they are partially or wholly obscured by the garment itself. Some of the devices have been expensive and others have been of a nature such that the labor costs incident to attaching them to the garment hangers or similar devices has severely limited if not destroyed their utility. Another problem has been that some of them become a permanent part of the garment hanger, thus, restricting the garment hanger to use only with garments which satisfy the particular indicia on the identification system.

SUMMARY OF THE INVENTION

This invention provides an inexpensive tally which may be quickly and easily mounted on a garment hanger in a position where it will, under all normal operating circumstances, remain clearly visible. The invention provides a tally which may be readily secured and readily removed from the hanger, thus giving flexibility to the use of the hanger. The tally, itself, is so designed that in one form it can be readily produced by mass production methods and shipped to the user in lengths consisting of a number of tallies interconnected by a thin neck portion, permitting the user to quickly and easily sever the individual tallies one from another at the point of use. In a further aspect of the tally system of which these particular tallies are a part, a mounting element is provided on the garment hanger or other article support which permits the individual tallies to be detachably secured to the hanger in such a manner that they are firmly held and are indexed against being tipped, rotated or otherwise displaced from their selected preferred position. This second aspect of the system contemplates such an element which can be added to hangers having a special facility for mounting the tally attaching device or alternatively it contemplates hangers which have the tally attaching device as an integral part of the hanger.

The many objects and advantages of this invention will become readily apparent to those skilled in the art from a consideration of the following detailed description of the preferred embodiment when read in conjunction with the accompanying drawings.

BRIEF DESCRIPTION OF THE DRAWINGS

FIG. 12*a* is an oblique view of the modified tally anchoring device illustrated in FIG. 11;

DESCRIPTION OF THE PREFERRED EMBODIMENT

Figure 1:
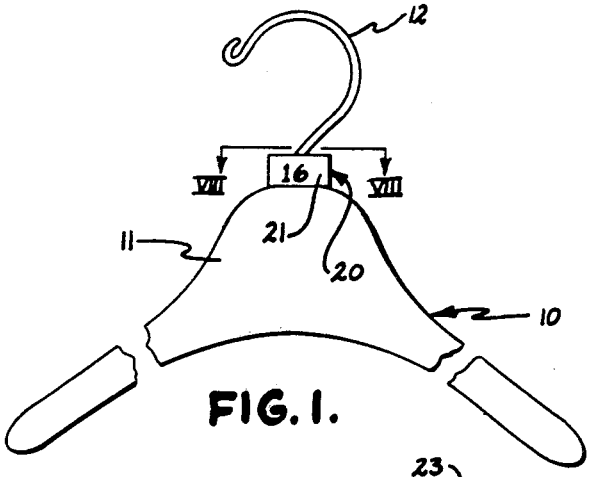
FIG. 1 is a front elevation view of a garment hanger equipped with the tally identification system of this invention.

The numeral 10 indicates a hanger of generally conventional construction having a header portion 11 and a supporting hook 12. It will be recognized that while a conventional hanger of one particular design is illustrated, the hanger may be of any of a large variety of designs. It will also be recognized that instead of the hanger some other type of article supporting device of somewhat similar function and concept can be substituted, which device can be supported from a slender element instead of the hook 12.

Mounted on this hanger is shown a tally 20. In the particular embodiment illustrated, the tally 20 has applied to its surface a suitable indicia 21. The indicia 21 may display any of many forms of information depending on the particular use to which the tally 20 is to be applied.

Figure 2:
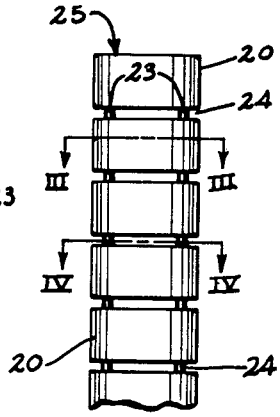
FIG. 2 is a fragmentary side elevation view of a blank incorporating a number of interconnected tallics.
Figure 3:
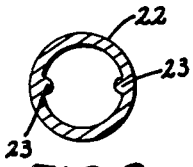
FIG. 3 is a sectional view taken along the plane III—III of FIG. 2.
Figure 4:
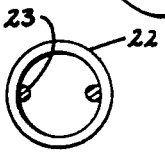
FIG. 4 is a sectional view taken along the plane IV—IV of FIG. 2.
Figure 7:
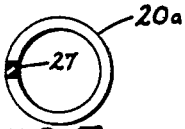
FIG. 7 is a sectional view taken along the plane VII—VII of FIG. 6.

FIGS. 2, 3 and 4 illustrate a preferred embodiment of the tally. In this embodiment, a continuous tube is extruded. As will be observed from the figures, the tube in its preferred form has thin circular walls 22 and a pair of inwardly extending ribs 23 arranged diametrically of the tube. The radial depth of the ribs may vary but as a practical matter, a depth approximately the wall thickness of the tube is functionally satisfactory. The tube is extruded as a continuous member and after extrusion, is subjected to a suitable cutting process whereby at equally spaced intervals along the tube, it is divided by severance lines 24 into a plurality of segments, each of which is a tally 20. It will be noted that the severance lines 24 entirely cut through the walls 22 of the tube but leave the ribs 23 in tact (FIGS. 2 and 4). In this manner, after the severance lines 24 are fully formed, each tally 20 is interconnected to each adjacent tally by a pair of the ribs 23, thus forming a blank 25. The length of the blank is determined by convenience. The blank, as originally formed, may be continuous but, for convenience sake, it is severed into suitable lengths such as one containing ten tallies. One blank of this type is severed from another simply by rupturing or cutting the remaining rib structure.

As will be explained subsequently, the individual tallies 20 are severed from the blank at the point of use, preferably by simply bending one of the tallies so that the ridge between that tally and the next adjacent tally formed by the remaining rib structure is ruptured. If this is inadequate to sever the tally from the blank, severance may be effected by cutting the remaining structure of the ribs.

Figure 5:
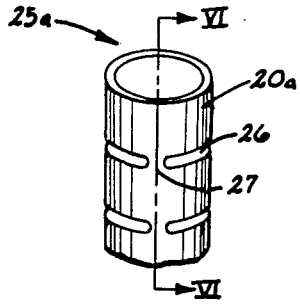
FIG. 5 is a fragmentary oblique view of a blank having a plurality of interconnected tallies; of a modified construction.
Figure 6:
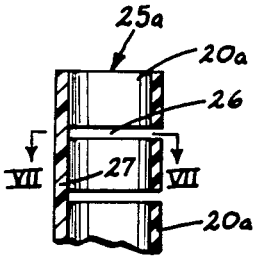
FIG. 6 is a fragmentary sectional view taken along the plane VI—VI of FIG. 5.

FIGS. 5 and 6 show a modified form of the tally wherein the rib structures are eliminated and instead the tallies **20*a* are obtained by rupture of the individual segments of a tube extruded without the ribs. This tube at periodic intervals is severed at 26 to separate and define the individual tallies 20*a*. Once again, the severance lines 26 do not entirely separate the tallies one from another, leaving, at one point, a thin, narrow bridge 27 for interconnecting the individual tallies 20*a* (FIGS. 5 and 6). With this arrangement, the individual tallies or sections of the blank 25*a*** can be severed from one another readily simply by breaking the bridge interconnecting the tallies.

The desired information such as the indicia 21 shown in FIG. 1 may be applied to the tallies either while the tallies are interconnected in the blank or after they have been severed to assume their individual identity. the indicia may be applied by means of a label or the like applied to the surface of the tally or it may be printed or silk screened on the surface of the tally. In fact, the manner in which the indicia are applied and the particular indicia applied to the individual tallies is not a part of this invention. In many cases, it may be desirable to apply the same indicia to all tallies interconnected as a single blank.

It is considered preferable that the tallies be made of an opaque material, preferably one having some degree of resiliency, yet having sufficient brittleness that they may be readily severed from the blank by rupture of the interconnecting bridge. It will be recognized that the tallies may be of any color which will give them visual distinctiveness yet blend with the articles and the hanger with which they are to be used. It has been found that a high impact styrene such as that sold by Dow Chemical Company, Product No. 430U is a suitable material for the manufacture of the blank and thus of the tallies. This material has the requisite flexibility, coupled with the requisite rupture characteristics to permit the tallies to be readily severed one from another as needed even though a limited degree of maneuvering or bending is permitted to effect separation as would be the case with the dual ribbed structure illustrated in FIGS. 2 and 3. It is important that the material be relatively low in cost because the cost of the tallies should not warrant any substantial care being exercised to save them. This is important from the standpoint of the user in conservation of expensive labor.

It is also important that in the preferred embodiment, the inside opening 29 of the tally be such that the tally may be installed on the hanger by passing it over the reversely bent hook portion of the hanger support. This is important to permit the tallies to be mounted on and removed from the hangers at will, both as needed and as required to permit a hanger to be used for different purposes requiring the replacement of a tally with one form of information with a tally with another form of information appropriate to its particular use.

Figure 8:
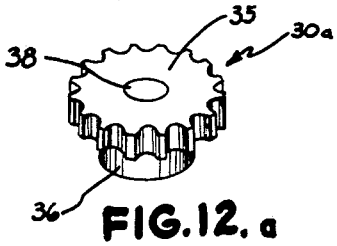
FIG. 8 is a fragmentary plan view taken along the plane VIII—VIII of FIG. 1 showing a tally mounted on a garment hanger.
Figure 8:
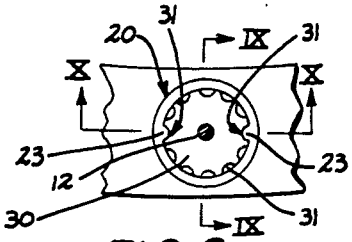
Figure 9:
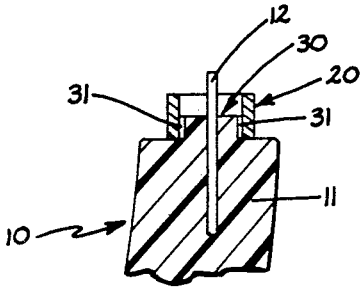
FIG. 9 is a fragmentary sectional view taken along the plane IX—IX of FIG. 8.
Figure 10:
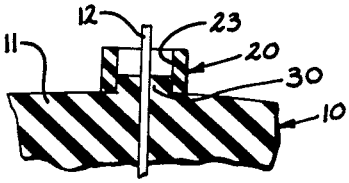
FIG. 10 is a sectional view taken along the plane X—X of FIG. 8.
Figure 12:
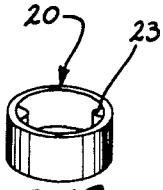
FIG. 12 is an oblique view of the tally shown in FIGS. 3 and 4.
Figure 13:
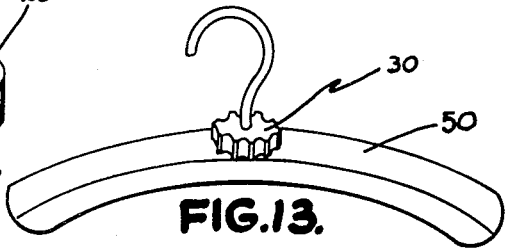
FIG. 13 is an oblique view of a hanger with an integral tally anchoring device.

To secure either the tally 20 or the tally **20*a* to the hanger, a boss 30 is provided (FIGS. 8, 9 and 10). In one form of the invention, the boss 30 is an integral part of the hanger and, thus, is molded as an upwardly extending protrusion surrounding the shaft portion of the hook 12. Except for the addition of the upstanding boss 30, the hanger 50, as illustrated in FIG. 13**, is conventional and may be of any suitable shape, type or form which may be molded from plastic.

The boss 30 has an external diameter which will snugly seat within the open center of the tallies 20 or **20*a*. The boss projects a short distance above the top of the hanger but this projection is preferably less than the height of the tally. Thus, when a tally is in place, the boss is entirely concealed. The boss is provided with a plurality of vertical grooves or channels 31 which open through the top of the boss. The channels 31 are of a size to receive the ribs 23 of the tally 20 as is illustrated in FIGS. 8 and 10. The number of channels 31** may be varied but, as least there must be a sufficient number to accommodate all of the ribs which project inwardly of the tallies. The cooperation of the ribs and channels index the tallies circumferentially. Thus, by providing a plurality of the channels the tally may be indexed in any of several different positions. This can be an important and useful feature under many operating circumstances. By positively indexing the tally with respect to the front and rear of the hanger, proper display of the tally's indicia is assured. By having a snug fit between the tally and the boss, the tallies are positively held against accidental displacement or loss, thus assuring their continued utility even though the hangers are handled frequently while the articles are being hung for display or shown to customers.

Figure 11:
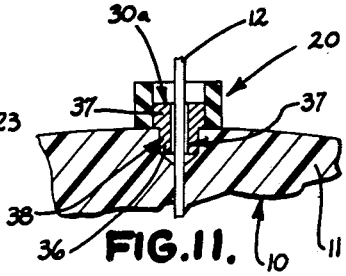
FIG. 11 is a fragmentary sectional view taken along the same plane as FIG. 10 illustrating a modified form of the tally anchoring device.

In a modified form of the invention, the boss 30*a* is fabricated as a separate component having an upper portion 35 identical to the upwardly projecting boss 31 and a lower or stem portion 36, preferably of a reduced diameter. In this arrangement, the hanger has an enlarged opening 37 formed in its header portion concentric with the opening for the shaft of the hook 12. The opening 37 is of a size such that the stem 36 may be press fitted into it to form a tight friction engagement between the boss 30*a* and the hanger, thus, firmly securing the boss 30*a* to the hanger (FIG. 11). The boss in this case is installed at the same time the hook 12 is secured to the hanger. By this arrangement, suitable bosses can be provided on non-plastic hangers such as wooden hangers, permitting the tally system of this invention to be used with such hangers.

If the boss 30 is molded integral with the hanger it, of course, will be of the same material. One of the commonly used materials for garment hangers is a high impact styrene. However, the required functional characteristics of the hanger will govern the material rather than the characteristics of the boss. In the case of the separate insert boss 30*a*, the material can be any one of a number of materials as, for example, a high impact polystyrene of the same type and grade as that used for the manufacture of the tallies.

The boss has to have a central opening to receive the hook 12. In the case of the boss 30, this central opening normally will be no bigger than that required for insertion of the hook. In the case of the boss 30*a*, this opening 38 can be made somewhat larger than the diameter of the hook 12 to provide a small clearance. This permits the hook 12 to be slightly off center with respect to the boss 30*a* or the hole 37 without resulting in interference when the boss is secured to the hanger 10.

The tallies are supplied to the operator in groups, that is, as a number of tallies interconnected as a blank as illustrated in FIGS. 2 and 6. If the appropriate indicia has already been applied to these tallies, the operator merely separates the tallies by rupturing the ribs 23 or the bridge 27. If the indicia has not been applied to the tally, the operator may apply the indicia either before or after separation from the blank. In this case, the indicia will probably be applied as a self-adhesive label.

The tally is passed over the hook and down the stem of the hook until it is seated against the header portion 11 of the hanger. In doing so, the tally is pressed over the boss 30 or 30*a*. If the tally is of the type having no internal ribs such as the tally 20*a*, it can be pressed down over the boss without regard to the location of the channels. In this case, a slight interference fit producing a snug engagement between the tally and the face of the boss is relied upon to hold the tally in place and to prevent it from rotating about the boss. In the case of the tallies 20 having the internal ribs 23, the tally 20 must be indexed so that the ribs 23 are seated in a pair of the channels 31. In this manner, the tally is specifically indexed rotationally about the boss and when it is pressed down to finally seat, it is locked positively against rotation. In the case of both types of tallies, preferably the interference fit is such that even though the hanger is turned upside down, the tallies will remain secured to the boss and will not fall off.

In some cases, more information may be needed than that which can be provided on a single tally. In that case, two or more tallies can be used by leaving the ribs or bridge between them intact. The tallies are adapted to very inexpensive manufacture since the basic tube, with or without the internal ribs is designed for extrusion as a continuous member and the formation of the severance lines 24 or 26 can be performed by automatic equipment. In fact, the necking 28 is also adapted for fully automatic equipment.

The principle of this invention can be incorporated into tallies of a number of different types and the means of anchoring and indexing to the hanger can also be of various different types.

Figure 15:
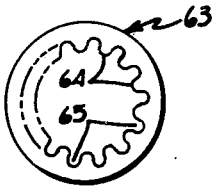
FIG. 15 is an end view of a still further modified form of the tally.
Figure 17:
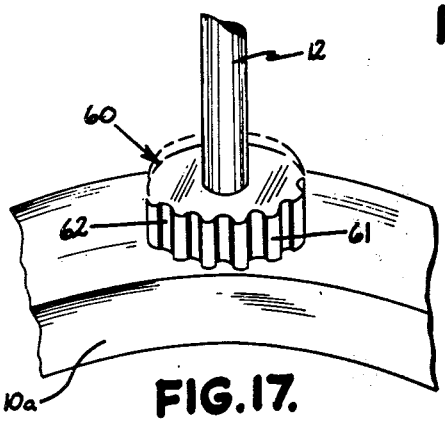
FIG. 17 is a fragmentary, oblique view of a hanger equipped with a modified form of the tally anchoring device.

FIGS. 15 and 17 illustrate a modification designed to provide interchangeability. In this construction, the hanger 10*a* is equipped with a tally anchor or upstanding boss 60. The boss 60 has an exterior configuration somewhat simulating a gear in that it has teeth or ribs 61 separated by valleys or grooves 62. In the preferred form, the size and shape of the ribs and valleys are identical, that is, any rib of one boss would seat in any valley of another boss. The tally 63 is similar to the tally 20 in that it is tubular but instead of the two ribs 23, it has a plurality of ribs or teeth 64 which are shaped and sized to seat in the valley 62 of the boss 60 with the channels or grooves 65 between the ribs 64 receiving the teeth or ribs 61 of the boss 60. By providing a substantial number of ribs and valleys the tally can be readily positioned circumferentially to effectively display its indicia.

If the tally 20 is designed with the ribs 23 shaped and sized to seat effectively in the valleys 62 of the boss 60 and the boss 60 is designed so that the ribs 61 and valleys 62 are arranged in diametrically positioned pairs, the tallies 20 and 63 can be used interchangeably.

The boss 60 may either be an integral part of the hanger 10*a* such as is suggested in FIG. 10 or it may be of the separate component type as suggested in FIG. 11.

Figure 18:
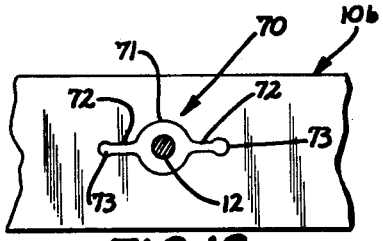
FIG. 18 is a fragmentary plan view of a hanger equipped with a further modified form of the tally anchoring device.
Figure 19:
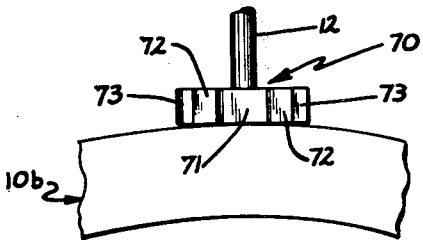
FIG. 19 is a fragmentary side elevation view of the hanger illustrated in FIG. 18.

FIGS. 18 and 19 illustrate the fact that the tally anchor need not necessarily be circular. In this construction, the boss 70 consists of an enlarged central section 71 surrounding the shank of the hook 12. A pair of web-like wings 72 extend diametrically from the central section 71. If these wings 72 are relatively thin, as illustrated, they terminate in bulbous ends 73. The size and shape of the ends 73 should be the same as that of the teeth or ribs 61 of the boss 60. In this manner, they will then mount the tally 63. If the webs 72 are thicker, the ends will not necessarily be bulbous but they will be shaped to simulate the teeth 61 of the boss 60. Preferably, the webs 72 and ends 73 extend vertically to the top surface of the hanger 10*b*.

The tally anchor 70 can either be molded as an integral part of the hanger 10*b* or it can be a separate component attached in the manner suggested in FIG. 11. If the anchor is of the latter type, the attachment stem will project from the central section 71.

Figure 20:
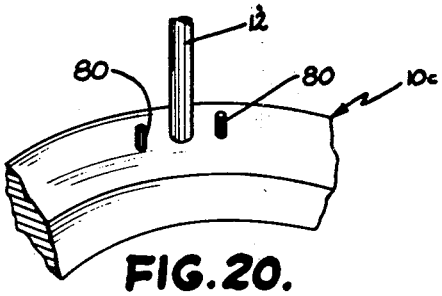
FIG. 20 is a fragmentary oblique view of a hanger equipped with another type of tally anchoring device.
Figure 21:
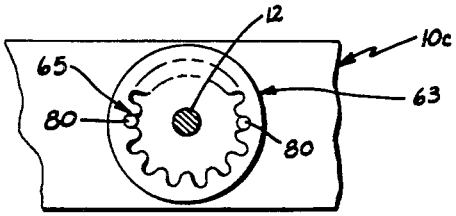
FIG. 21 is a fragmentary plan view of the hanger illustrated in FIG. 20 showing a tally mounted on the hanger.

FIGS. 20 and 21 illustrate the fact that when tallies of the type of tally 63 are used, the boss can be dispensed with altogether, while retaining the feature of positive anchoring and flexibility of circumferential indexing. In this case, a pair of pins 80 project upwardly from the top surface of the hanger 10*c*. The pins 80 are cross-sectionally shaped to closely seat in the grooves or valleys 65 of the tally 63. They are also arranged diametrically of the shank of the hook 12 and shaped to seat effectively in a pair of the valleys 65 (FIG. 21).

The pins 80 may be molded projections integral with the body of the hanger 10*c* or they may be separate components having one end press fitted into a suitable hole in the hanger body. In this latter case, the hangers can be molded with the holes and the pins added subsequently to convert the hanger to one adapted for use of the indentification system of this invention. If separate pins 80 are used, they can be of any suitable material such as plastic or metal.

It will be recognized that hangers equipped with an integral boss to utilize the tally identification system of this invention can be of almost any body design or construction suitable for plastic molding. For example, any of the bosses 30, 60 or 70 or the pins 80 can be molded integrally with the types of hangers disclosed in U.S. Pat. Nos. 3,306,506; 3,698,607, 3,746,223, 3,767,092 and No. Re. 26,949.

Figure 25:
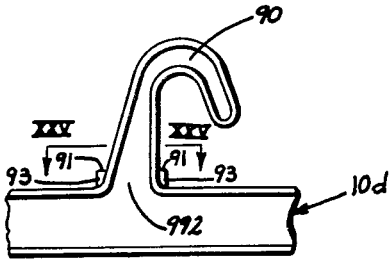
FIG. 25 is a fragmentary side view of a hanger modified to accept this invention.
Figure 26:
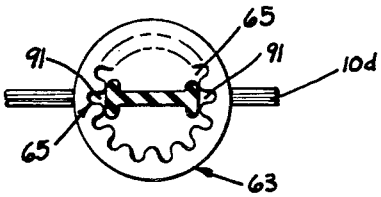
FIG. 26 is an enlarged sectional view taken along the plane XXVI—XXVI with the tally mounted.

In the case of hangers having a non-circular, integral, molded hook such as disclosed in U.S. Pat. No. 3,767,092, the tally can be made large enough to accommodate the base width of the hook. As suggested in FIGS. 25 and 26, when the integral hook 90 of the hanger 10*d* is of sufficient width at the base, a pair of laterally extending shoulders 91 can be molded integrally with the base 92. These shoulders will be shaped and sized to be received in the valleys 65 of a tally 63. The spacing between the vertical end faces 93 of the shoulders can be designed to properly seat in the valleys 65 as suggested in FIG. 26. In this manner, a hanger 10*d* suitable for this invention can be provided by redesign of a hanger such as that disclosed in U.S. Pat. No. 3,698,607.

It will be understood that in all of the anchoring devices which have been described, the preferred interfit between the tally and the boss or anchoring shoulders is such as to provide a snug frictional engagement whereby the tally is effectively held against unintentional displacement under normal conditions of usage.

Figure 14:
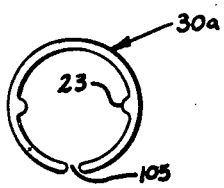
FIG. 14 is an end view of a further modified form of the tally.
Figure 16:
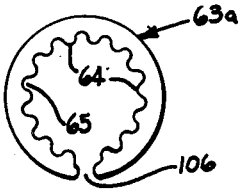
FIG. 16 is an end view of another modified form of the tally.

FIGS. 14 and 16 illustrate a modification of the tally to permit it to be installed on the boss of a hanger having a hook which will not permit a tally of an acceptable diameter to be installed by passing it over the end of the hook. The tally 30*a* is of the same construction as tally 30 except for the split 105 (FIG. 14). The tally 63*a* is of the same construction as tally 63 except for the split 106 (FIG. 16). Preferably, the tallies 30*a* and 63*a* should be fabricated with thicker wall sections to compensate for the weakening effect of the split while retaining adequate clamping force to retain them on the boss.

Figure 22:
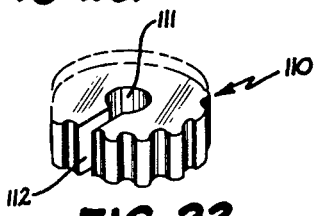
FIG. 22 is an oblique view of another type of tally anchoring device.

FIG. 22 illustrates a modified boss 110 which can be added to existing hangers to adapt them to the identification system of this invention. While the boss 110 is illustrated as incorporating the rib and valley design of boss 63, it could just as well incorpoate the circumferential wall design of boss 30 (FIG. 8). The boss 110 can be molded as an individual component or extruded as a continuous rod and sliced into individual components. It is equipped with a central opening 111 to seat about the shank of the hanger's hook. The opening 111 is open to the edge of the boss by means of the slot 112. If the boss is fabricated of a sufficiently resilient material, the slot 112 can be somewhat narrower than the diameter of the shank of the hook. If the material lacks the necessary resilience, the slot can be made sufficiently wide to pass the shank. In either case, the boss 110, at the time of installation is preferably permanently attached to the hanger by suitable means such as an adhesive bond. This bond can be to the hanger body or it could be to the shank of the hook when the hanger's design does not provide a flat bonding surface.

Figure 23:
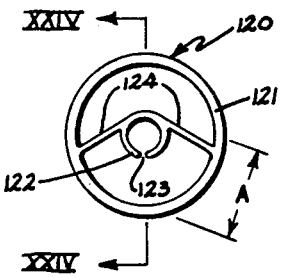
FIG. 23 is an end view of still another modified form of a tally.
Figure 24:
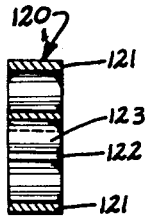
FIG. 24 is a sectional view taken along the plane XXIV—XXIV of FIG. 23.

FIGS. 23 and 24 illustrate a tally adapted for use with hangers having no boss. The tally 120 is tubular having a circular peripheral wall 121 and a central, somewhat horseshoe-shaped clamp 122 having a gap 123 in its wall. The clamp 122 is connected to the wall 121 by a pair of webs 124. The webs 124 preferably form a "V" and are integral with the clamp 122 at its back wall opposite from the gap 123. This arrangement permits the tally to be squeezed from the sides where the webs 124 and wall 121 join to increase the spacing A. By occupying the center of the tally with the clamp 122, the space available to pass the tally over the end of the hook is restricted. This problem can be overcome by enlarging the tally. However, this is not desirable. Therefore, by so constructing the tally that the spacing A can be enlarged, the problem can be overcome for most hanger hook constructions without increase in tally size.

All of the several types of tallies can be fabricated either by segmenting a continuous extrusion or by being molded as an individual component. The indicia can be applied by any suitable method. When the indicia is applied, it may be indexed to the ribs of the tally. However, it may also be so applied as by printing wherein the circumferential location of the indicia is random. It is because of this that the provision of numerous ribs and valleys is desirable because this permits a wide choice of indexing positions. By repeating the indicia at several points about the circumference of the tally, the time required for the operator installing the tallies to properly index a tally can be reduced. The exact type and manner of indicia application is not a limiting factor to this invention since the invention is capable of accommodating any of them. An advantage of using the blanks consisting of a number of interconnected tallies is that this arrangement automatically orients the tallies for the operator, that is, the operator having once determined that the indicia on the blank is properly oriented for mounting, can then proceed to mount all of the tallies of the blank without further inspection of the individual tallies. This saves substantial time over the necessity for inspecting each individual tally.

Since the tallies, when seated on either of the bosses which have been disclosed are firmly and positively supported, a wall thickness which gives them enough structural and shape integrity to facilitate installation is all that is necessary. This economy of material contributes significantly to their low cost. One of the advantages of this invention is the fact that the tallies can be manufactured of a resilient material. This, in combination with a reduced wall thickness provides tallies which can be squeezed to distort them into an oval or oblong shape to pass them over the loop or eye normally provided at the free end of the hook. By doing this, the tally can be designed to have a diameter too small to pass this loop in a free or undistorted condition. This prevents the tally from being lost, should it be used with a hanger having no anchor boss or it becomes dislodged from the boss.

It will be recognized that while the tallies are preferably circular, this is not necessarily essential. They could be square, triangular or oval. However, if the tallies are non-circular, the bosses can be but are not necessarily non-circular. In the case of non-circular tallies without the internal ribs, a non-circular, cross section of the boss can be substituted for the ribs as the indexing means. It will also be recognized that in the case of article supports of a suitable construction the tally need not necessarily surround the hook. In this case, the tally anchor may be offset to one side of the supporting element such as the hook. This could be done, for example, with a garment hanger having a long, flat top.

While a preferred embodiment of this invention together with several modifications of that embodiment have been described, it will be recognized that other modifications of this invention incorporating the principles of the invention can be made. Such modifications of the invention are to be considered as included in the hereinafter appended claims, unless these claims by their language expressly state otherwise.

The embodiments of the invention in which an exclusive property or privilege is claimed are defined as follows.

1. A blank of tallies for use with article display devices, said blank having an elongated body of a material subject to fracture upon bending, said body being tubular and having thin, circular inner and outer walls, said inner wall including an inwardly projecting tally indexing rib extending axially the length thereof; said body defining a plurality of cuts spaced lengthwise of said body dividing said body into a plurality of axially spaced segments; said segments being attached one to another only by said rib whereby said segments, when needed, can be separated by fracturing said rib.

2. A blank of tallies for use with article display devices as described in claim 1 wherein said rib projects inwardly from the inner face of said body approximately the thickness of said body and is defined by a variation in a wall thickness of said body.

3. A blank of tallies for use with article display devices as described in claim 4 wherein said body has a pair of said ribs, said ribs being arranged diametrically of said body.

4. A blank for tallies for use with article display devices as recited in claim 1 wherein article identification indicia are applied to the exterior surface thereof.

5. A blank of tallies for use with article display devices, said blank having an elongated tubular body of a material subject to fracture upon bending, said body defining an axially extending narrow slit extending the length of said body and radially through said body, said body having an inwardly facing axially extending indexing rib extending the length thereof, said body defining a plurality of cuts spaced lengthwise of said body dividing said body into a plurality of tally segments.

6. A blank of tallies as defined by claim 5 wherein said body has a plurality of indexing ribs, said ribs being equally spaced and said body further having a plurality of parallel, axially extending equally spaced channels, said ribs being interspaced between said channels and said channels in cross section being a negative image of said ribs.

7. A blank of tallies as defined by claim 6 wherein said plurality of tally segments are axially spaced by said cuts and said segments are attached one to another only by said rib.

8. A blank of tallies for use with article display devices, said blank comprising:

an elongated tubular body, said body having a plurality of cuts spaced lengthwise of said body and dividing said body into a plurality of tally segments, each segment having an annular exterior shell and a web spanning the interior opening thereof, said web of each said segments being V-shaped as viewed from one end of said body, and on each side of the apex of said V having a pair of arms extending toward each other to define a generally circular passage extending axially of each of said tally segments and generally concentrically of said exterior shell of each of said tally segments, the ends of said arms being spaced apart to define a gap.

* * * * *

UNITED STATES PATENT AND TRADEMARK OFFICE

CERTIFICATE OF CORRECTION

PATENT NO. : 4,198,773

DATED : April 22, 1980

INVENTOR(S) : John H. Batts et al

It is certified that error appears in the above-identified patent and that said Letters Patent are hereby corrected as shown below:

Column 9, line 38:

"4" should be --2--;

Column 10, line 20:

"6" should be --5--.

Signed and Sealed this

Fourth Day of November 1980

[SEAL]

*Attest:*

SIDNEY A. DIAMOND

*Attesting Officer*

*Commissioner of Patents and Trademarks*